US005083844A

United States Patent [19]

Gruenberg et al.

[11] Patent Number: 5,083,844

[45] Date of Patent: Jan. 28, 1992

[54] MODULAR SHOWCASE

[75] Inventors: George Gruenberg; Francisco Bruce, both of Lima, Peru

[73] Assignee: Union Construcciones, Lima, Peru

[21] Appl. No.: 615,429

[22] Filed: Nov. 16, 1990

[51] Int. Cl.[5] ..... A47B 81/00

[52] U.S. Cl. ..... 312/140; 312/238

[58] Field of Search ..... 312/114, 140, 238

[56] References Cited

U.S. PATENT DOCUMENTS

| | | | |
|---|---|---|---|
| D. 48,027 | 10/1915 | French . | |
| D. 85,605 | 11/1931 | Thompson . | |
| D. 105,447 | 7/1937 | Urbanek . | |
| D. 116,455 | 9/1939 | Vaughn . | |
| D. 116,456 | 9/1939 | Vaughn . | |
| D. 129,258 | 9/1941 | James . | |
| D. 134,687 | 12/1942 | Waltman . | |
| D. 195,389 | 6/1963 | Graziano . | |
| D. 200,987 | 4/1965 | McLean et al. . | |
| D. 256,530 | 8/1980 | Johnson . | |
| D. 276,298 | 11/1984 | Miller . | |
| D. 276,486 | 11/1984 | Miller . | |
| D. 276,677 | 12/1984 | Miller . | |
| D. 276,678 | 12/1984 | Miller . | |
| D. 276,679 | 12/1984 | Miller . | |
| D. 276,680 | 2/1984 | Miller . | |
| D. 277,533 | 2/1985 | Miller . | |
| D. 279,739 | 7/1985 | Aspenwall . | |
| 283,374 | 8/1883 | Bufford . | |
| D. 286,110 | 10/1986 | Carvel . | |
| 1,779,218 | 10/1930 | Schmalzgruber . | |
| 2,482,174 | 9/1949 | Hake . | |
| 2,629,643 | 2/1953 | Davidson | 312/238 |
| 3,224,823 | 12/1965 | Schulze | 312/114 X |
| 3,717,395 | 2/1973 | Spielvogel et al. . | |
| 4,102,275 | 7/1978 | Spound et al. . | |
| 4,162,113 | 7/1979 | Pallavicini . | |
| 4,291,928 | 9/1981 | Kiyasawa | 312/140 X |
| 4,426,120 | 1/1984 | Johnson et al. . | |

*Primary Examiner*—Joseph Falk

*Attorney, Agent, or Firm*—Kenyon & Kenyon

[57] ABSTRACT

A modular showcase has at least one corner unit and at least two straight units coupled thereto. Additional straight units and/or corner units can be coupled thereto in an end to end fashion to form numerous different showcase arrangements.

15 Claims, 6 Drawing Sheets

FIG. 5
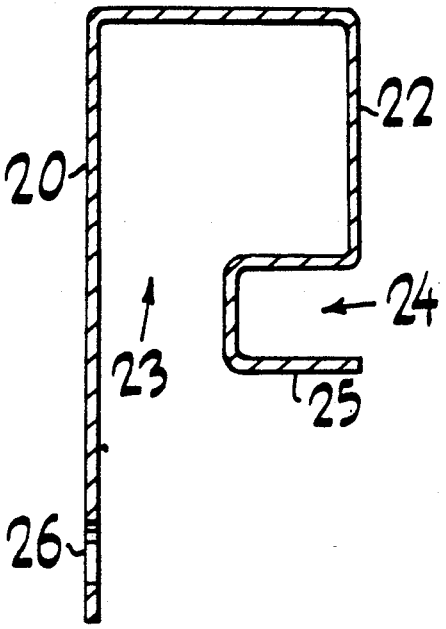
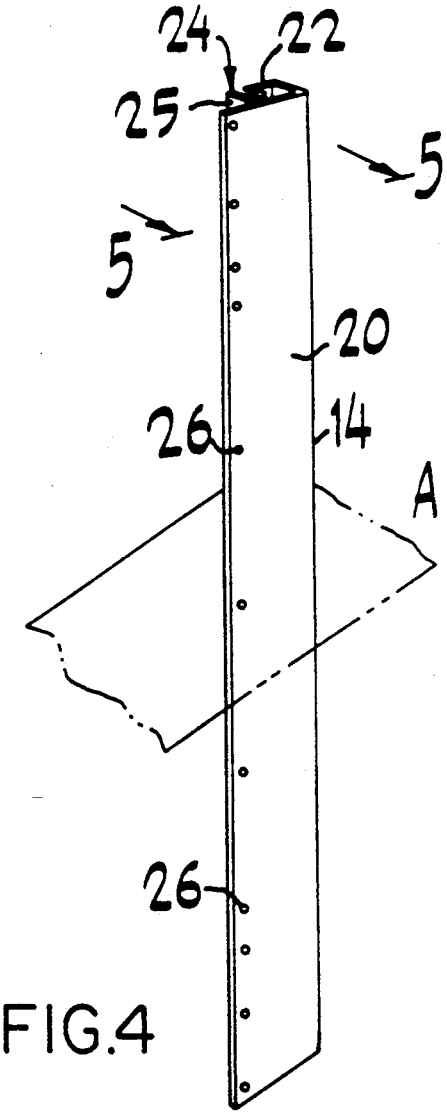
FIG.4
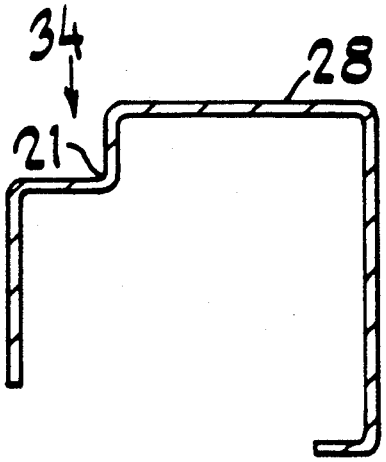
FIG. 6
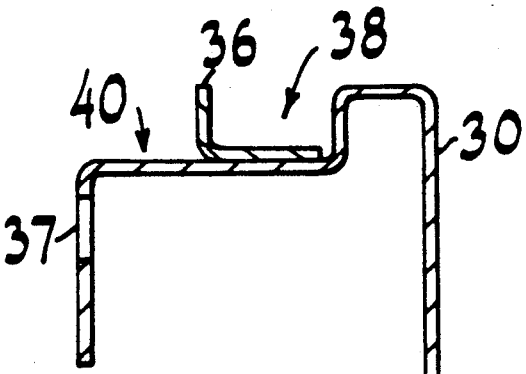
FIG. 7

MODULAR SHOWCASE

FIELD OF THE INVENTION

The present invention relates to furniture and, in particular, to modular furniture, such as modular display furniture and showcases for displaying articles therein.

BACKGROUND INFORMATION

Display furniture and, in particular, modular display furniture is frequently used in department and other types of retail stores to display goods for sale. A typical piece of display furniture has a glass enclosure, one or more shelves for displaying goods thereon within the glass enclosure, and one or more lights for illuminating the interior of the glass enclosure. Modular display furniture ordinarily includes several units, wherein each unit has a separate glass enclosure for displaying goods therein. The units are typically arranged in a pattern to form an attractive display and/or to form an area behind the units to accommodate sales people.

Known display furniture is typically custom designed for each retailer's particular application and to fit within a particular floor plan. Because the furniture is custom designed, it typically has a heavy construction and includes many components that are assembled together in a permanent fashion. Thus, it is ordinarily an expensive and time consuming process to design, manufacture, ship, set up, and later knock down known display furniture. Moreover, such display furniture typically lacks any versatility in its ability to be arranged in more than one pattern. These disadvantages can result in substantial increases in a retail store owner's overhead costs.

It is an object of the present invention, therefore, to overcome the problems of known display furniture.

SUMMARY OF THE INVENTION

The present invention is directed to a modular showcase. The modular showcase comprises two straight units, each including a first bottom panel defining two front corners and two rear corners. Each straight unit further includes four legs, each leg including a back portion defining a plurality of first holes spaced apart from each other and extending therethrough. The first holes are arranged in a pattern symmetric about a plane intersecting the midpoint of the leg and oriented substantially perpendicular to the axis thereof.

Each leg is coupled to a respective corner of the first bottom panel by securing a fastener through a first hole of the leg and through the panel. Accordingly, two of the legs become the two front legs, and the other two legs become the rear legs of the straight unit. The symmetric pattern of first holes permits each leg to be coupled to any of the four corners of the bottom panel.

Each leg further includes a front portion extending in a direction substantially parallel to the back portion and spaced apart therefrom. The front and back portions thus define a first gap therebetween. The front portion defines a first lip and a first channel therein. The first channel is adapted to support a transparent panel therein. Each end unit further comprises a first top frame coupled to each leg. The first top frame, first bottom panel, and legs thus form a rigid straight unit structure.

The modular showcase further comprises at least one corner unit including a second bottom panel. The second bottom panel defines two front corners and one rear corner. The second bottom panel is adapted to be coupled to the two straight units by securing fasteners through the second bottom panel and through the adjacent first holes of the legs of the respective straight units.

Each corner unit further comprises a second top frame defining two front corners and one rear corner. The second top frame is coupled to the two straight units by securing fasteners therethrough and through the adjacent first holes of the legs of the respective straight units. Each corner unit further includes two vertical supports, each defining a plurality of second holes spaced apart from each other and extending therethrough. Each second hole corresponds in position to a first hole of a respective front leg. Each vertical support is coupled to a front leg of a respective straight unit by securing fasteners through the respective first and second holes. Each vertical support further defines a second channel adapted to support a transparent panel therein.

The modular showcase further includes at least one end cover defining a first flange on one side thereof and a second flange on the other side thereof. Each flange includes a plurality of third holes spaced apart from each other and extending therthrough. Each third hole corresponds in position to a respective first hole of a leg of a straight unit. The end cover is adapted to be coupled to one end of a straight unit by inserting the first and second flanges into the first gaps of the front leg and rear legs, respectively. Then, fasteners are secured through the third holes and corresponding first holes of the flanges and legs, respectively.

The modular showcase further comprises at least two panel supports adapted to be supported on one end of a straight unit in place of an end cover and to support a transparent panel therein. Each panel support includes a first panel defining a second channel therein adapted to support a transparent panel therein. Each panel support further includes a second panel coupled to the first panel and defining a second lip therein.

The second panel further defines a plurality of fourth holes spaced apart from each other and extending therethrough. Each of the fourth holes corresponds in position to a respective first hole in a leg. The fourth holes are arranged in a pattern symmetric about a plane intersecting the midpoint of the panel support, and oriented substantially perpendicular to the axial direction thereof. This arrangement of the fourth holes facilitates the interchangeability of the panel supports.

The first and second panels further define a second gap therebetween. Each panel support is adapted to be coupled to a front or rear leg of a straight unit in an interlocking manner. First, the back portion of the respective leg is inserted into the second gap of the panel support until the second lip of the panel support abuts the first lip of the leg. The second channels of the two panel supports are thus adapted to support the edges of a transparent panel therein.

The modular showcase of the present invention preferably further comprises a plurality of first shelf supports. Each first shelf support extends between a front and rear leg thereof and is supported therefrom. The straight unit further comprises at least one first shelf supported by the two first shelf supports located on either end of the straight unit.

The corner unit also preferably includes a plurality of second shelf supports. Each second shelf support extends between a front and rear leg of an adjacent straight unit and is supported therefrom. The corner unit further includes at least one second shelf supported by the two second shelf supports. Each second shelf support is supported from a different straight unit.

A modular showcase of the present invention further comprises at least one first transparent panel supported on either end within the first channel of each respective front leg of the straight unit. At least one second transparent panel is supported on either end within a second channel of each respective vertical support of the corner unit.

A modular showcase of the present invention further comprises a door frame coupled to the first bottom panel and extending between the two vertical legs of the straight unit. The door frame defines a first door channel therein, and a second door channel therein oriented substantially parallel to the first door channel. Each straight unit further comprises a first sliding door and a second sliding door. Each sliding door is supported on one end within the first door channel or second door channel, respectively, and extends between the door frame and the first top frame of the straight unit. Each sliding door is thus adapted to slide relative to the other to access the interior of the end unit and adjacent corner unit.

One advantage of the modular showcase of the present invention, is that it comprises relatively few components and each of the components has a simple structure facilitating the inexpensive manufacture and rapid assembly thereof.

Another advantage of the showcase of the present invention, is that several of the components are interchangeable, thus, further reducing the manufacturing costs thereof. For example, each of the vertical legs are interchangeable, as are the panel supports.

Another advantage of the showcase of the present invention, is that it can be easily expanded by adding additional straight units and/or corner units to form any of a number of desired arrangements. The vertical legs on the corners of each straight unit are adapted to easily couple the vertical legs of an adjacent straight unit thereto. Likewise, each corner unit is adapted to be easily coupled to the vertical legs of a straight unit. Thus, the modular showcase can be rapidly and inexpensively expanded, while maintaining a rigid frame structure. Yet, the modular showcase can also be rapidly disassembled to move the showcase or rearrange the showcase into a new pattern.

Another advantage of the showcase of the present invention, is that it provides the user with the choice of having either an opaque end cover or a clear or tinted transparent panel supported on the free end of each straight unit. The opaque end cover can easily be replaced with a transparent panel, or vice versa.

Other advantages of the showcase of the present invention will become apparent in view of the following detailed description and drawings taken in connection therewith.

BRIEF DESCRIPTION OF THE DRAWINGS

FIG. 4 is a perspective view of a typical vertical leg of the straight unit of FIGS. 2A and 2B.

FIG. 5 is a cross-sectional view of the vertical leg of FIG. 4 taken along the line 5—5 thereof.

FIG. 6 is a cross-sectional view of the front horizontal support of the straight unit of FIGS. 2A and 2B taken along the line 6—6 thereof.

FIG. 7 is a cross-sectional view of the rear horizontal support of the straight unit of FIGS. 2A and 2B taken along the line 7—7 thereof.

DETAILED DESCRIPTION

Figure 1:
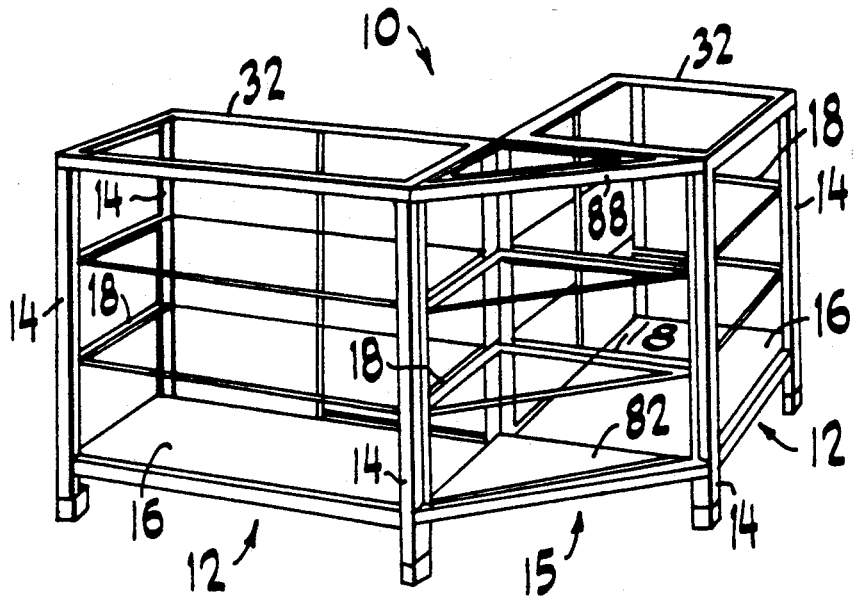
FIG. 1 is a perspective view of a modular showcase embodying the present invention.
Figure 2A:
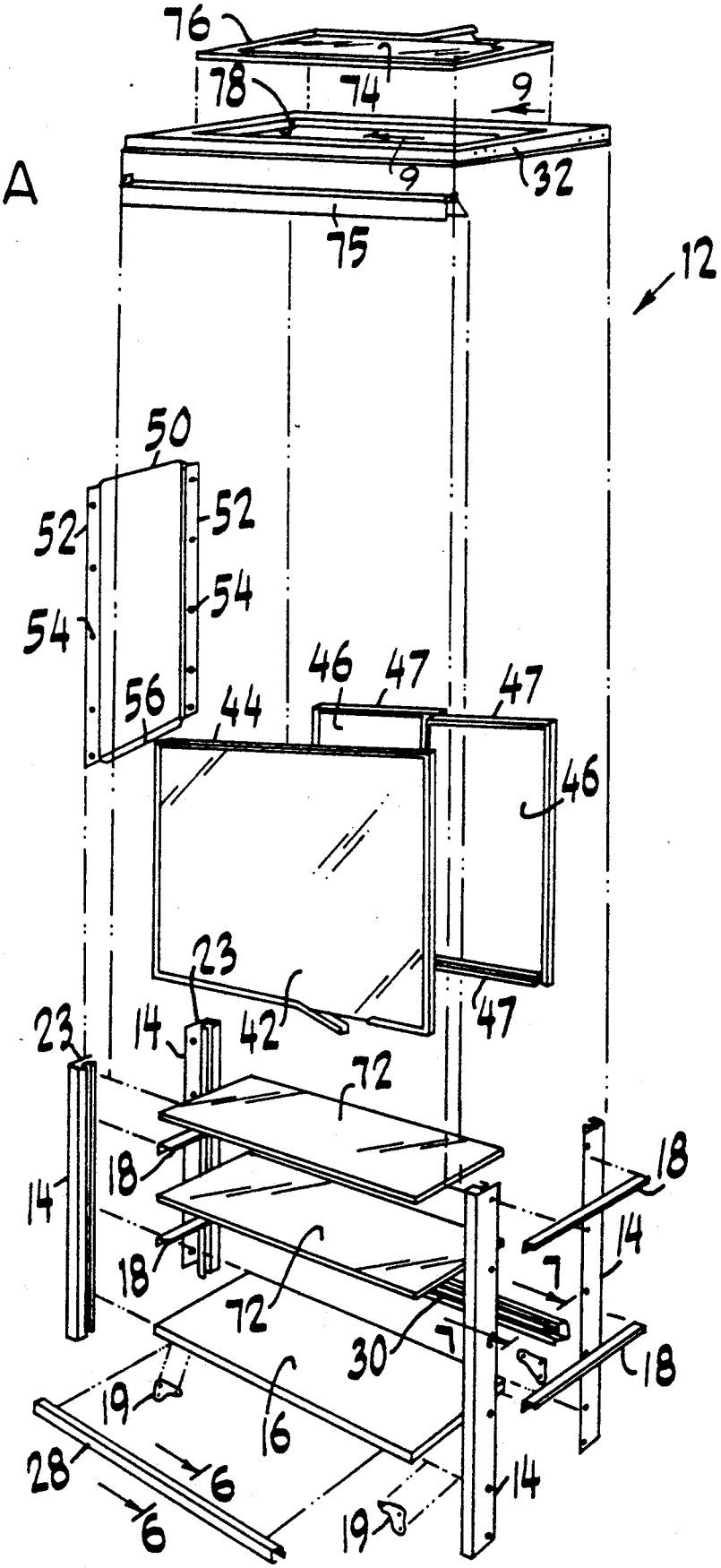
FIG. 2A is an exploded perspective view of a straight unit of the showcase of FIG. 1 including an end cover on one end thereof.
Figure 2B:
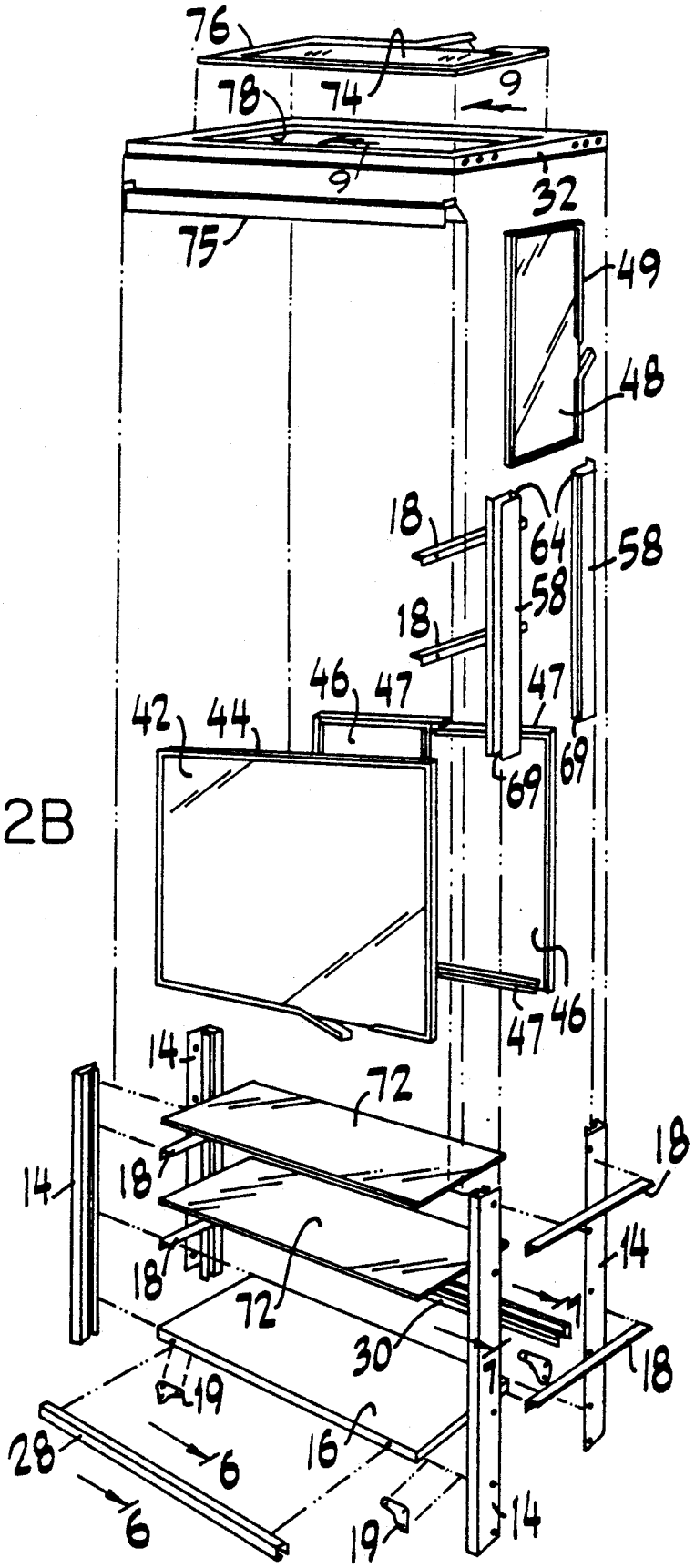
FIG. 2B is an exploded perspective view of a straight unit of the showcase of FIG. 1 including a glass panel on one end thereof.

In FIG. 1, a modular showcase embodying the present invention is indicated generally by the reference numeral 10. The modular showcase 10 is generally L-shaped and comprises two straight units 12, and a corner unit 15 coupled therebetween. As shown in FIGS. 2A and 2B, the straight unit 12 comprises four vertical legs 14. Each vertical leg 14 is coupled on its bottom end to a respective corner of a bottom panel 16. Two corner plates 19 are each coupled between a respective front corner of the bottom panel 16 and a vertical leg 14, to stiffen the connection therebetween. Several shelf supports 18 are each coupled on either end to the adjacent vertical legs 14 on either end of the straight unit 12. A top frame 32 is supported on the other end of each vertical leg 14 and coupled thereto.

As shown in FIG. 1, the vertical legs 14, bottom panel 16, shelf supports 18, corner plates 19, and top frame 32 are assembled to form a rigid frame for supporting the other components of the respective straight unit 12. Each of these components is preferably stamped and formed from relatively light gauge steel. Thus, as will be recognized by those skilled in the art, the components of the straight unit 12 can be inexpensively manufactured, and the end unit can, in turn, be rapidly assembled therefrom.

In FIGS. 4 and 5, a typical vertical leg 14 is shown in further detail. The vertical leg 14 includes a back panel 20 and a front panel 22. The front panel 22 has formed therein a first channel 24, which is dimensioned to receive and support a glass panel 42 assembled in rubber trim 44, as shown in FIGS. 2A and 2B. The outer wall of the first channel 24 is defined by a lip 25, which extends along the length of the leg 14 and is oriented substantially perpendicular to the back panel 20. Each vertical leg 14 has a generally U-shaped cross section and defines a gap 23 between the back panel 20 and the bottom wall of the first channel 24, as shown in FIG. 5.

The back panel 20 includes a plurality of holes 26 formed therethrough. The holes 26 are spaced apart from each other along the length of the vertical leg 14, and are each adapted to receive a respective fastener (not shown), for mounting the shelf supports 18 thereto.

As shown in FIG. 4, the holes 26 are located in a symmetric pattern with respect to a plane A bisecting the vertical leg 14 in a direction perpendicular to the longitudinal axis thereof. Thus, one advantage of the apparatus of the present invention, is that the vertical legs 14 are each identical, and any leg can be coupled to any corner of the straight unit 12 by simply flipping the vertical leg 14 with respect to the plane A.

Turning again to FIGS. 2A and 2B, each straight unit 12 further comprises a front horizontal support 28 coupled to the front end of the bottom panel 16 and extending between the two front vertical legs 14. As further shown in FIG. 6, the support 28 has formed therein an indentation 21 extending along the back edge thereof. The indentation 21 thus forms a second channel 34 when the front horizontal support 28 is coupled to the bottom panel 16. The second channel 34 is dimensioned to receive and support the bottom edge of the glass panel 42 assembled in rubber trim 44, as shown in FIGS. 2A and 2B. The second channel 34 is located in line with each first channel 24 of the front vertical legs 14. Thus, the bottom edge of the glass panel 42 is supported within the second channel 34, and the side edges of glass panel 42 are supported within the first channels 24 of the two front vertical legs 14.

The straight unit 12 further comprises a rear horizontal support 30, extending between the two rear vertical legs 14 and coupled to the rear edge of the bottom panel 16. The rear horizontal support 30 includes a divider 36 projecting upwardly therefrom and extending along its length in the axial direction, as shown in FIG. 7. The divider 36 thus forms a first door channel 38 on one side thereof, and a second door channel 40 on the other side thereof. Each door channel 38 and 40 is adapted to slidably support therein the bottom portion of a respective sliding door 46, as described further below. Several holes, indicated typically by the reference numeral 37, extend through a side wall on either end of the rear support 30, and are each dimensioned to receive a fastener (not shown) to couple the rear support 30 to the bottom panel 16.

Figure 9:
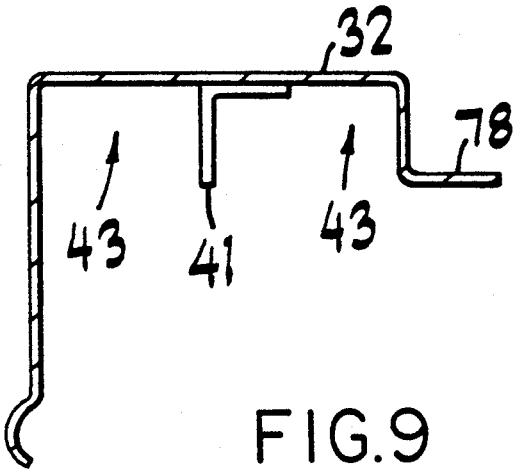
FIG. 9 is a partial cross-sectional view of the top frame of the straight unit of FIGS. 2A and 2B taken along the line 9—9 thereof.

The top frame 32 includes a dividing portion 41 extending along the underside of the rear portion thereof, as shown in FIG. 9. The dividing portion 41 thus forms two door channels 43 on either side thereof. Each door channel 43 extends along the length of the rear portion of the top frame 32 in a direction parallel to and directly above the door channels 38 and 40, respectively. Each door channel 43 is thus adapted to slidably support the top portion of a respective sliding door 46, as described further below.

Figure 8:
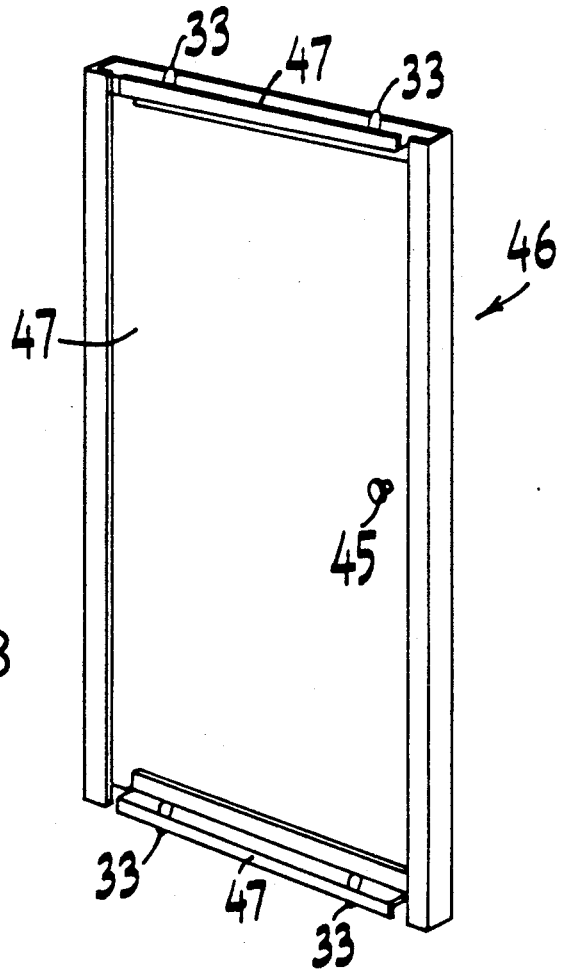
FIG. 8 is a perspective view of a typical sliding door of the straight unit of FIGS. 2A and 2B.

A typical sliding door 46 is shown in further detail in FIG. 8. Each sliding door 46 has two L-shaped supports 47, one extending along the bottom edge thereof, and the other extending along the top edge thereof. Two plastic posts 33 are each coupled to either end of each respective L-shaped support 47, and are each adapted to be received in a respective door channel 38, 40, as shown in FIG. 7, and 43, as shown in FIG. 9. Thus, the bottom edge of one sliding door 46 is seated within the door channel 38, and the top edge is seated within the door channel 43 located directly above. The bottom edge of the other sliding door 46 is likewise seated within the door channel 40, and the top edge is seated within the door channel 43 located directly above. Thus, each sliding door 46 is mounted to slide within the pairs of door channels 38 and 43, and 40 and 43, respectively. A door knob 45 is mounted on each sliding door 46 to grip and, thus, open and close the door.

As shown in FIG. 2A, each straight unit 12 further comprises an end cover 50 adapted to be coupled by fasteners (not shown) to the end thereof opposite the corner unit 15. However, as shown in FIG. 2B and described further below, a glass panel 48 adapted to be assembled within grooves, can be used in place of the end cover 50, depending on the user's particular application and/or aesthetic preferences.

The end cover 50 can either be transparent or opaque, but is preferably opaque and stamped from sheet metal. The end cover 50 includes two vertical flanges 52 projecting outwardly therefrom and extending along each vertical edge thereof. Each vertical flange 52 includes several holes 54 spaced apart from each other and extending therethrough. The holes 52 are arranged in a pattern so that each hole corresponds in position to a hole 26 in a respective vertical leg 14. The holes 54 are adapted to receive fasteners (not shown) to couple the end cover 50 to the adjacent front or rear vertical legs 14. A bottom lip 56 extends along the bottom edge of the end cover 50, and is bent inwardly in a direction substantially perpendicular to the plane of the end cover. The vertical flanges 52 are dimensioned to be received within the gaps 23 of the front and rear vertical legs 14.

The end cover 50 is assembled to the straight unit 12 by slipping the flanges 52 into the gaps 23 of the respective front and rear vertical legs 14, as shown in FIG. 2A. The bottom lip 56 is in turn seated below the edge of the bottom panel 16. The end cover 50 is secured to the respective front and rear vertical legs 14 by securing fasteners (not shown) through the holes 54 in the flanges 52 and the corresponding holes 26 in the vertical legs 14.

Figure 11:
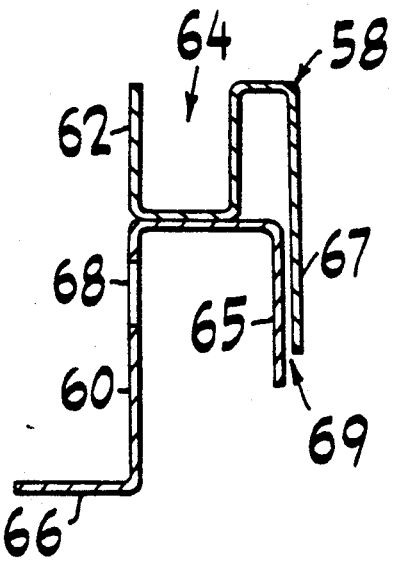
FIG. 11 is a cross-sectional view of the glass support of FIG. 10 taken along the line 11—11 thereof.
Figure 10:
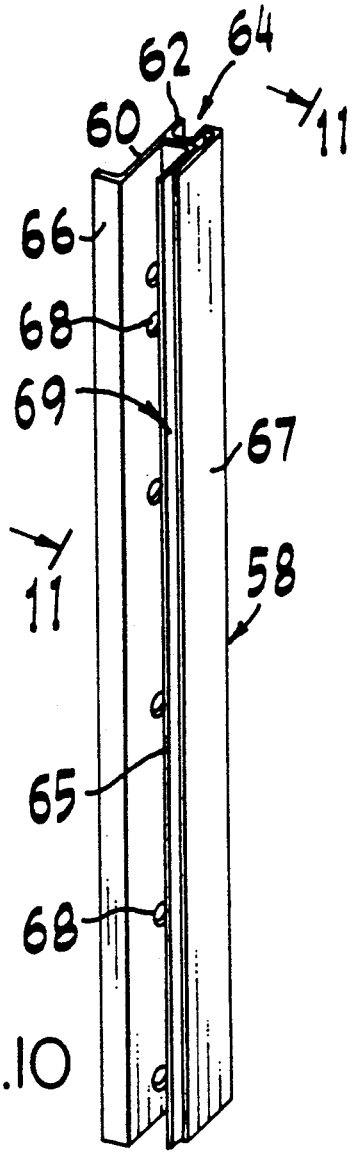
FIG. 10 is a perspective view of a typical glass support of the straight unit of FIG. 2B.

As mentioned above, a glass panel 48 can be selected instead of the end cover 50, as shown in FIG. 2B. The glass panel 48, as with the glass panel 42, can be made of another material, such as a suitable plastic, and can either be clear, tinted, or, if desired, opaque. The glass panel 48 is assembled to the end unit 12 by using two end glass supports 58, shown typically in FIGS. 10 and 11. Each end glass support 58 includes an outer panel 60 and an inner panel 62. As shown in FIG. 11, the inner wall of the inner panel 62 is coupled to the inner wall of the outer panel 60. The inner panel 62 has formed therein a U-shaped glass channel 64 extending along the axial length thereof. The channel 64 is adapted to receive and support one edge of the glass panel 48 assembled in rubber trim 49. The outer panel 60 defines a lip 66 projecting outwardly therefrom and extending in the axial direction of the glass support 50. The lip 66 is adapted to abut the lip 25 of a respective vertical leg 14, as described further below. The outer panel 60 further defines a first wall 65, which extends substantially perpendicular to the lip 66.

The inner panel 62 defines a second wall 67, which extends substantially parallel to the first wall 65 and is spaced therefrom. The first wall 65 and second wall 67 thus define a gap 69 therebetween. The gap 69 is dimensioned to receive the back panel 20 of a respective vertical leg 14 therein, as described further below. Each outer panel 60 has formed therethrough a plurality of holes 68 spaced apart from each other in the axial direction of the support 58. Each of the holes 68 are positioned to correspond to a respective hole 26 of a respective vertical leg 14. The holes 68 are arranged in a symmetrical pattern about a plane intersecting the midpoint of the support 58 in its axial direction, and oriented substantially perpendicular thereto, to facilitate the interchangeability of the glass supports.

Each end glass support 58 is coupled to a respective vertical leg 14 in an interlocking manner, as indicated in FIG. 2B. The first and second walls 67 and 69, respectively, of the glass support 58, are fitted over the respective leg 14 so that the outer panel 20 is, in turn, inserted into the gap 69. The glass support 58 is then pushed toward the respective leg 14, until the lip 66 of the glass support abuts the lip 25 of the leg. Each glass support 58 is then secured to the respective leg 14, by securing fasteners (not shown) through the holes 69 and the corresponding holes 26 of the glass support and leg, respectively. Once the glass support 58 is coupled to the leg 14, the first wall 67 of the glass support covers the holes 26 to provide the exterior of the straight unit with a smooth and aesthetically pleasing appearance. On the interior of the straight unit 12, the shelf supports 18 are coupled to the two glass supports 58 by securing fasteners (not shown) through the shelf supports and the holes 68 of the glass supports 68.

The glass panel 48 assembled in rubber trim 49 is then assembled to the straight unit 12 by simply slipping the side edges thereof into the channels 64 of the glass panel supports 58, as indicated in FIG. 2B. Thus, one advantage of the showcase of the present invention is its flexibility in permitting a first type of panel (an end cover 50) or a second type of panel (a glass panel 48) to be assembled to either end thereof. Moreover, either type of end panel can be either opaque, tinted or clear transparent, and can be made from any of a number of different types of materials and/or colors depending on the particular aesthetic characteristics desired by an end user.

Each straight unit 12 further comprises several shelf panels 72. Each shelf panel 72 is supported on opposite ends by a pair shelf supports 18. The top frame 32 also includes a top shelf 74, which includes a rubber trim 76 assembled to the periphery thereof. The rubber trim 76 is adapted to be seated within a recessed flange 78 in the top frame 32. Both the shelf panels 72 and top shelf 74 are preferably made of glass, but can equally be made of other materials, such as a suitable plastic, and can either be clear, tinted or opaque.

Each straight unit 12 further comprises a fluorescent lamp support 75 coupled to the underside of the front portion of the top frame 32. The lamp support 75 is adapted to support a fluorescent lamp therefrom (not shown) to illuminate the interior of the straight unit 12 and adjacent corner unit 15. Each straight unit 12 further includes several end caps 80, which are each adapted to be fitted over the bottom end of a respective vertical leg 14 and coupled thereto. Each end cap 80 provides a suitable surface for supporting the showcase 10 on the floor.

The corner unit 15 is assembled to one end of each adjacent straight unit 12, thus fixing the two straight units and the corner unit into a rigid L-shaped configuration, as shown in FIG. 1. As will be recognized by those skilled in the art, the corner unit 15 can be coupled to the straight units 12 to extend the showcase in either the left or right directions.

Figure 3:
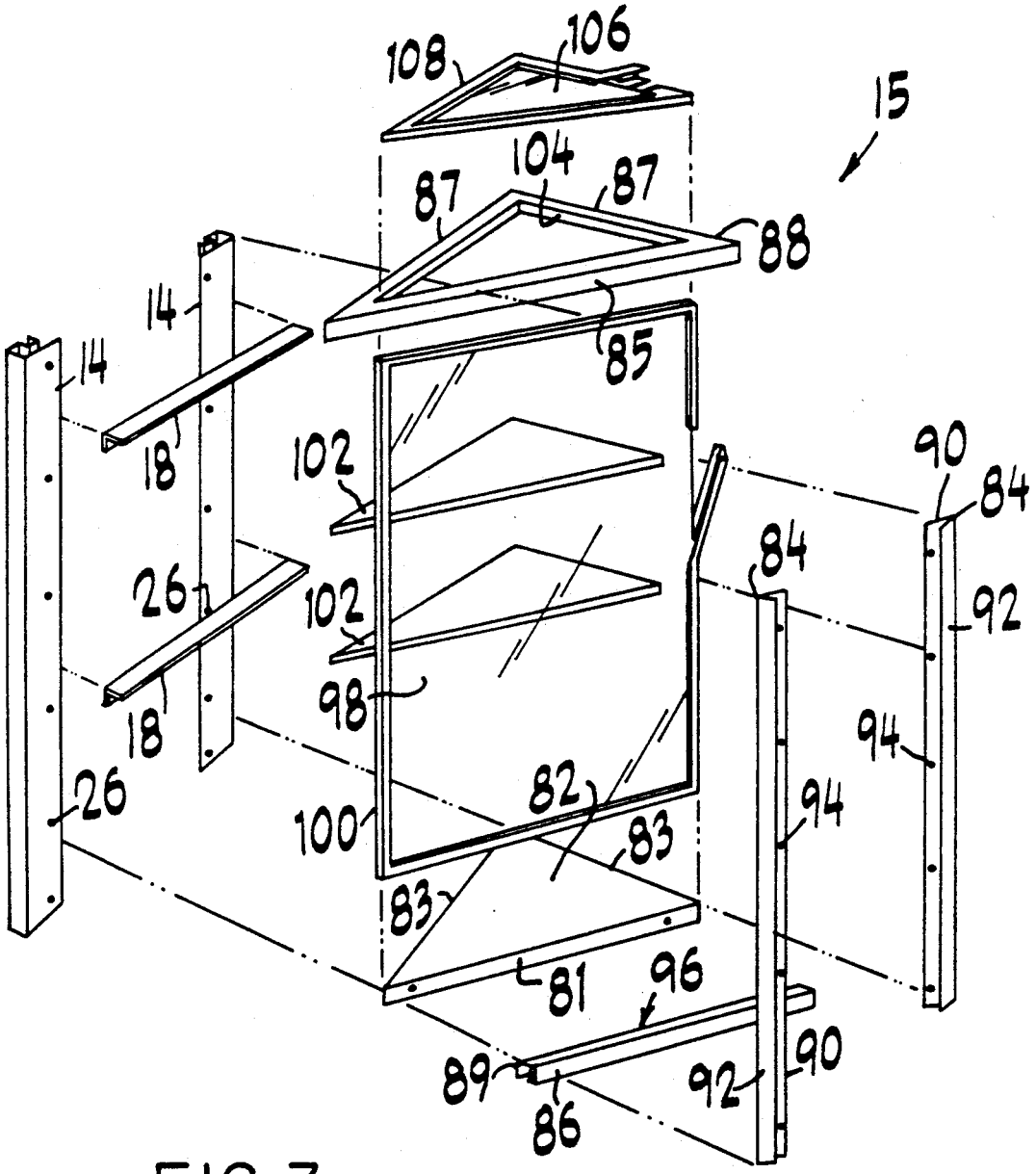
FIG. 3 is an exploded perspective view of the corner unit of the showcase of FIG. 1.

As shown in FIG. 3, the corner unit 15 comprises a corner bottom panel 82, a corner top frame 88, and two vertical supports 84. The corner bottom panel 82 is triangular and, thus, includes a front edge 81 and two back edges 83. Each back edge 83 is coupled to the side of the bottom panel 16 of a respective straight unit 12, and to the panel 20 of each respective vertical leg 14, by securing fasteners (not shown) through the edges 83 and adjacent holes 26 of the legs 14.

The corner top frame 88 is also triangular and, thus, includes a front edge 85 and two back edges 87. Each back edge 87 is coupled to the adjacent edge of the top frame 32 of each respective straight unit 12 by fasteners (not shown). Each corner vertical support 84 has a triangular cross-section, and includes a back panel 90 and a front panel 92. The back panel 90 has a plurality of holes 94 spaced apart from each other and extending therethrough. The holes 94 are spaced relative to each other and each corresponds in position to a hole 26 in a respective vertical leg 14. Each back panel 90 is dimensioned to be supported against a respective front vertical leg 14 of the adjacent straight unit 12 and coupled thereto by fasteners (not shown). The fasteners are secured through the holes 94 of the back panel 90 and the adjacent holes 26 of the respective vertical leg 14.

The corner unit 15 further comprises a corner horizontal support 86. The corner support 86 extends between the corner vertical supports 84, and is coupled to the front edge 81 of the corner bottom panel 82 by fasteners (not shown). The corner horizontal support 86 defines an indentation 89 extending along the back edge thereof. The indentation 89 thus forms a glass channel 96 when the corner horizontal support 86 is coupled to the corner bottom panel 82. The glass channel 96 is dimensioned to receive and support the bottom edge of a front panel 98 assembled in rubber trim 100. The front panel 98 is preferably made of glass, but can be made of other materials, such as a suitable plastic, and can be either tinted or clear transparent or, if desired, opaque. The space between the front panel 92 and back panel 90 of each corner vertical support 84 is, in turn, adapted to receive and support a respective side edge of the glass panel 98 assembled in rubber trim 100. Thus, the front glass panel 98 is supported on its bottom edge by the glass channel 96, and on its side edges by the back and front panels 90 and 92, respectively, of the respective corner vertical supports 84.

The corner unit 15 further comprises several shelf supports 18 coupled to and extending between the vertical legs 14 on the adjacent end of the straight unit 12 by fasteners (not shown). Each support shelf 18 is located next to another support shelf coupled to the opposite straight unit 12. Each pair of support shelves are located in the same plane and, thus, define a support surface for supporting a triangular shelf 102 thereon.

The top corner frame 88 has formed therein a recessed flange 104. The recessed flange 104 is dimensioned to receive and support a top triangular panel 106 assembled in rubber trim 108 extending along the periphery thereof. The shelf 102 and panel 106 are preferably made of glass, but can otherwise be made of a suitable plastic, for example, and can be either tinted or clear transparent or opaque.

As will be recognized by those skilled in the art, another advantage of the showcase of the present invention is that it can easily be expanded by adding additional straight units and corner units and, thus, form numerous different arrangements. For example, another corner unit 15 can be coupled to the other end of either straight unit 12 and can be positioned so that additional straight units can be coupled thereto and extend in either direction. Thus, the modular showcase 10 can be expanded by adding additional straight sections (the straight units 12) and/or right angle sections (the corner units 15) to form any of numerous arrangements. Moreover, each unit is secured to the next, thus forming a fixed and rigid arrangement which, however, can be rapidly disassembled and/or rearranged.

We claim:

1. A modular showcase comprising:

two straight units, each straight unit including a first bottom panel defining two front corners and two rear corners;

four legs, each leg including a back portion defining a plurality of first holes spaced apart from each other and extending therethrough, the first holes being arranged in a pattern symmetric about a plane intersecting the midpoint of the leg and oriented substantially perpendicular to the axis thereof, each leg being coupled to a respective corner of the first bottom panel by securing a fastener through a first hole thereof to the first bottom panel, two legs thus becoming the front legs and the other two legs thus becoming the rear legs of each straight unit, the symmetric pattern of first holes permitting each leg to be coupled to any of the four corners of the bottom panel, each leg further including a front portion extending in a direction substantially parallel to the back portion and spaced apart therefrom, the front and back portions thus defining a first gap therebetween, the front portion defining a first lip and a first channel therein, the first channel being adapted to support a transparent panel therein;

a first top frame coupled to each leg, the first top frame, first bottom panel and legs thus forming a rigid straight unit structure;

at least one corner unit including a second bottom panel defining two front corners and one rear corner, the second bottom panel being adapted to be coupled to the two straight units by securing fasteners through the second bottom panel and through the adjacent first holes of the legs of the respective straight units;

a second top frame defining two front corners and one rear corner, the second top frame being coupled to the two straight units by securing fasteners therethrough and through the adjacent first holes of the legs of the respective straight units;

two vertical supports, each defining a plurality of second holes spaced apart from each other and extending therethrough and a second channel adapted to support a transparent panel therein, each second hole corresponding in position to a first hole of a front leg of a respective straight unit, and each vertical support being coupled to a front leg of a respective straight unit by securing fasteners through the respective first and second holes;

at least one end cover defining a first flange on one side thereof and a second flange on the other side thereof, each flange including a plurality of third holes spaced apart from each other and extending therethrough, each third hole corresponding in position to a respective first hole of a leg, the end cover being adapted to be coupled to one end of a straight unit by inserting the first and second flanges into the first gaps of the front leg and rear legs, respectively, and, in turn, securing fasteners through the third holes and corresponding first holes of the flanges and legs, respectively;

at least two panel supports adapted to be supported on one end of a straight unit in place of an end cover and to support a transparent panel therein, each panel support including a first panel defining a second channel therein adapted to support a transparent panel therein, each panel support further including a second panel coupled to the first panel and defining a second lip therein, the second panel further defining a plurality of fourth holes spaced apart from each other and extending therethrough, each of the fourth holes corresponding in position to a respective first hole of a leg, the fourth holes further being arranged in a pattern symmetric about a plane intersecting the midpoint of the panel support and oriented substantially perpendicular to the axial direction thereof and, thus, facilitating the interchangeability of the panel supports, the first and second panels further defining a second gap therebetween, each panel support being adapted to be coupled to a front or rear leg of a straight unit in an interlocking manner by inserting the back portion of the respective leg into the second gap of the panel support until the second lip of the panel support abuts the first lip of the leg, the second channels of the two panel supports thus being adapted to support the edges of a transparent panel therein.

2. A modular showcase as defined in claim 1, wherein each straight unit further comprises:

a plurality of first shelf supports, each first shelf support extending between a front and rear leg thereof and supported therefrom; and at least one first shelf supported by two first shelf supports located on either end of the straight unit.

3. A modular showcase as defined in claim 1, wherein each corner unit further comprises:

a plurality of second shelf supports, each second shelf support extending between a front and rear leg of an adjacent straight unit and supported therefrom; and at least one second shelf supported by two second shelf supports, each second shelf support being supported from a different straight unit than the other second shelf support supporting the same shelf.

4. A modular showcase as defined in claim 1, further comprising:

at least one first transparent panel supported on either end within the first channel of each respective front leg of the straight unit; and at least one second transparent panel supported on either end within a second channel of each respective vertical support of the corner unit.

5. A modular showcase as defined in claim 1, wherein each straight unit further comprises:

a door frame coupled to the first bottom panel and extending between the two rear legs of the straight unit, the door frame defining a first door channel therein, and a second door channel therein oriented substantially parallel to the first door channel; and a first sliding door and a second sliding door, each sliding door being supported on one end within the first door channel or second door channel, respectively, and extending between the door frame and the first top frame of the straight unit, each sliding door being adapted to slide relative to the other to access the interior of the straight unit and adjacent corner unit.

6. A modular showcase as defined in claim 1, further comprising:

a first top shelf supported within the first top frame; and a second top shelf supported within the second top frame.

7. A modular showcase, comprising:

at least two straight units, each straight unit including a first bottom frame defining two front corners and two rear corners;

a first top frame defining two front corners and two rear corners;

four legs, each leg being adapted to extend between respective corners of the first bottom frame and first top frame and to be coupled thereto, each leg including a back portion defining a plurality of first holes spaced apart from each other and extending therethrough, the first holes being arranged in a pattern symmetric about the midpoint of each leg in the axial direction thereof, each leg being coupled on either end to the first bottom panel and first top panel by securing fasteners through the first holes to the respective panels, the symmetric pattern of first holes thus facilitating the interchangeability of the legs, each leg further including a front portion spaced apart from the back portion and thus defining a first gap therebetween, the front portion further defining a first lip and first channel therein, the first channel being adapted to receive and support the edge of a panel therein;

at least one corner unit adapted to be coupled between the at least two straight units, each corner unit including a second bottom frame defining two front corners and one rear corner;

a second top frame defining two front corners and one rear corner;

two vertical supports, each vertical support being adapted to extend between respective front corners of the second bottom frame and the second top frame and to be coupled to a vertical leg of an adjacent straight unit, each vertical support defining a plurality of second holes spaced apart from each other and extending therethrough and a second channel adapted to receive and support the edge of a panel therein, each second hole corresponding in position to a first hole of a respective leg, and each vertical support thus being adapted to be coupled to a vertical leg of an adjacent straight unit by securing fasteners between the corresponding first and second holes;

at least one first panel adapted to be secured by fasteners to the legs of a respective straight unit, each first panel including a first flange on one side thereof and a second flange on the other side thereof, each flange including a plurality of third holes spaced apart from each other and extending therethrough, each third hole corresponding in position to a respective first hole of a leg, each first panel thus being adapted to be coupled to one end of a straight unit by inserting the first and second flanges into the respective first gaps of the legs on either side of the straight unit and, in turn, securing fasteners through the third holes and corresponding first holes of the flanges and legs, respectively;

at least two panel supports adapted to be coupled to one end of a straight unit and to receive and support within channels at least one second panel instead of a first panel, each panel support including a front panel defining a second channel therein adapted to receive and support one edge of the second panel therein, each panel support further including a back panel coupled to the front panel and defining a second lip therein, the back panel further defining a plurality of fourth holes spaced apart from each other and extending therethrough, each of the fourth holes corresponding in position to a respective first hole of a leg, the front and back panels further defining a second gap therebetween, each panel support being adapted to be coupled to a respective leg of a straight unit in an interlocking manner by slipping the second gap of the panel support over the back portion of the leg until the second lip of the panel support abuts the first lip of the leg, the second channels of the two panel supports thus being adapted to receive and support the opposite edges of a second panel therein.

8. A modular showcase as defined in claim 7, wherein the at least one first panel is opaque; and the at least one second panel is tinted or clear transparent.

9. A modular showcase as defined in claim 7, wherein the second holes of each vertical support are arranged in a pattern symmetric about the mid-point of the vertical support in the axial direction thereof, thus facilitating the interchangeability of the vertical supports; and the fourth holes of each panel support are arranged in a pattern symmetric about the mid-point of the panel support in the axial direction thereof, thus facilitating the interchangeability of the panel supports.

10. A modular showcase as defined in claim 7, wherein the front and back panels of each panel support are adapted to cover the first holes of a respective leg when coupled thereto in an interlocking manner to provide a more aesthetically pleasing appearance.

11. A modular showcase as defined in claim 7, wherein each straight unit further comprises:

a plurality of first shelf supports, each first shelf support extending between two legs on one end of the straight unit and being supported therefrom by extending fasteners through the shelf supports and corresponding first holes of the legs; and at least one first shelf supported by two first shelf supports located on either end of the straight unit.

12. A modular showcase as defined in claim 7, wherein each corner unit further comprises:

a plurality of second shelf supports, each second shelf support extending between two legs on one end of an adjacent straight unit and supported therefrom by securing fasteners through the shelf support and corresponding first holes of the respective legs; and at least one second shelf supported by two second shelf supports, each second shelf support being supported from a different straight unit than the other shelf support supporting the same shelf.

13. A modular showcase as defined in claim 7, further comprising:

at least one first transparent panel supported on either end within the first channel of each respective leg on the front side of a straight unit; and at least one second transparent panel supported on either end within a second channel of each respective vertical support of a corner unit.

14. A modular showcase as defined in claim 7, wherein each straight unit further comprises:

a door frame coupled to the first bottom frame and extending between the two legs on either side thereof, the door frame defining a first door channel therein, and a second door channel therein oriented substantially parallel to the first door channel; and a first sliding door and a second sliding door, each sliding door being supported on one end within the first door channel or second door channel, respectively, and extending between the door frame and the first top frame of the straight unit, each sliding door being adapted to slide relative to the other to access the interior of the straight unit and adjacent corner unit.

15. A modular showcase as defined in claim 7, further comprising:

a first top shelf supported within the first top frame; and a second top shelf supported within the second top frame.

* * * * *